United States Patent [19]

van den Akker

[11] Patent Number: 4,921,094

[45] Date of Patent: May 1, 1990

[54] PRODUCT/CARD COMBINATION

[76] Inventor: Koos van den Akker, 2109 Broadway, New York, N.Y. 10023

[21] Appl. No.: 355,571

[22] Filed: May 22, 1989

[51] Int. Cl.[5] ..... B65D 73/00; G09F 23/00

[52] U.S. Cl. ..... 206/232; 40/124.1; 206/457

[58] Field of Search ..... 206/232, 278, 457, 459; 40/124.1, 299, 533–535

[56] References Cited

U.S. PATENT DOCUMENTS

| | | | |
|---|---|---|---|
| 626,137 | 5/1899 | Broadway . | |
| 1,576,636 | 3/1926 | Egan | 40/124.1 |
| 2,096,960 | 10/1937 | Colby . | |
| 2,111,520 | 3/1938 | White . | |
| 2,314,721 | 3/1943 | Lowenstein | 40/124.1 |
| 2,589,409 | 3/1952 | Leichter . | |
| 2,696,690 | 12/1954 | Kellerer . | |
| 3,307,281 | 3/1967 | Mateo . | |
| 3,638,343 | 2/1972 | West . | |
| 3,866,815 | 2/1975 | Desmond | 40/124.1 |
| 4,024,656 | 5/1977 | Farnsworth | 40/124.1 |
| 4,177,593 | 12/1979 | Lockey . | |
| 4,234,079 | 11/1980 | Otake | 206/459 |
| 4,305,501 | 12/1981 | Collette | 206/459 |
| 4,440,298 | 4/1984 | Knight . | |
| 4,622,768 | 11/1986 | Moreau . | |
| 4,648,548 | 3/1987 | Shin | 206/459 |
| 4,840,275 | 6/1989 | Faiola et al. | 206/459 |

FOREIGN PATENT DOCUMENTS

| | | | |
|---|---|---|---|
| 2819641 | 11/1979 | Fed. Rep. of Germany | 206/459 |
| 1403094 | 5/1965 | France | 206/459 |
| 2061821 | 5/1981 | United Kingdom | 40/124.1 |
| 2191173 | 12/1987 | United Kingdom | 206/387 |

*Primary Examiner*—Jimmy G. Foster

*Attorney, Agent, or Firm*—Wolder, Gross & Bondell

[57] ABSTRACT

An occasional greeting device consists of the combination of a gift item, such as an item of wearing apparel, having a display panel portion thereon and a greeting card connected to the item. The card has a first, exposed panel bearing a representation of the gift item, the portion of said representation depicting the display panel portion being exised to form an opening in the panel. A second interior panel is hinged to the first panel, and bears a message sought to be delivered by said card. The message is located on the second panel such that a portion of the message appears through the opening in the front panel when said panel is closed; the message portion so appearing preferably being of an abstract character. The display portion of the gift item bears a copy of the message portion appearing through the opening, thus creating a relationship between the card and gift item, the true intent thereof being known only to the item recipient.

4 Claims, 2 Drawing Sheets

PRODUCT/CARD COMBINATION

The present invention relates to a greeting card in combination with an associated article of commerce and, in particular, to such a card and article which are intended to be sold and transferred as a unit.

BACKGROUND OF THE INVENTION

The use of greeting or occasion cards to transmit a sentiment has long been recognized. Typically, such a card bears a chosen phrase reflective of the sentiment sought to be transmitted and, in an appropriate case, may be accompanied by a gift of an item appropriate to the occasion, whether it be a birthday, wedding or anniversary, as a thank you, or otherwise. Typically, upon receipt of the card and gift, the recipient reviews the card, opens and examines the gift, and subsequently discards the card, passing the sentiment to the trash heap.

It is a purpose of the present invention to provide a greeting or occasion card which, by the use of appropriate graphics, is particularly associated with a gift item to which it is affixed and with which it is delivered.

Yet a further purpose of the present invention is to provide a combination occasion card and gift item which are physically coupled together, the gift portion of which bears indicia which have the capability of transmitting the sentiment displayed by the card to the recipient, while presenting an apparently abstract appearance to the world at large.

BRIEF DESCRIPTION OF THE INVENTION

In accordance with the above and other objects, the present invention comprises a greeting card having front and inner faces inscribed with indicia appropriate to the sentiment sought to be conveyed. The card is coupled to a display element, typically a gift item such as a sweater, a representation of which appears on the front surface of the card. A window through the card surface within the borders of the representation of the gift item on the card allows a portion of the sentiment appearing on the inside of the card to be visible through the window when the card is closed, the sentiment portion thus appearing to be positioned on the gift item representation. The gift item to which the card is coupled itself is provided with a display area which bears the identical indicia as appears through the card window, the indicia portion chosen to appear in the window and being duplicated on the gift item normally having an abstract appearance when viewed separately from the entire sentiment appearing on the inside surface of the card. Thus, while the gift article appears to the general public as bearing merely an abstract design, the recipient of the gift and card recognizes the indicia as part of the specific sentiment transferred from the donor to the donee, thus retaining the sentiment even after separation of the card from the gift item.

BRIEF DESCRIPTION OF THE DRAWINGS

A fuller understanding of the present invention may be accomplished upon consideration of the following detailed description of a preferred, but nonetheless illustrative embodiment of the invention when reviewed in conjunction with the annexed drawings wherein.

DETAILED DESCRIPTION OF A PREFERRED EMBODIMENT

Figure 1:
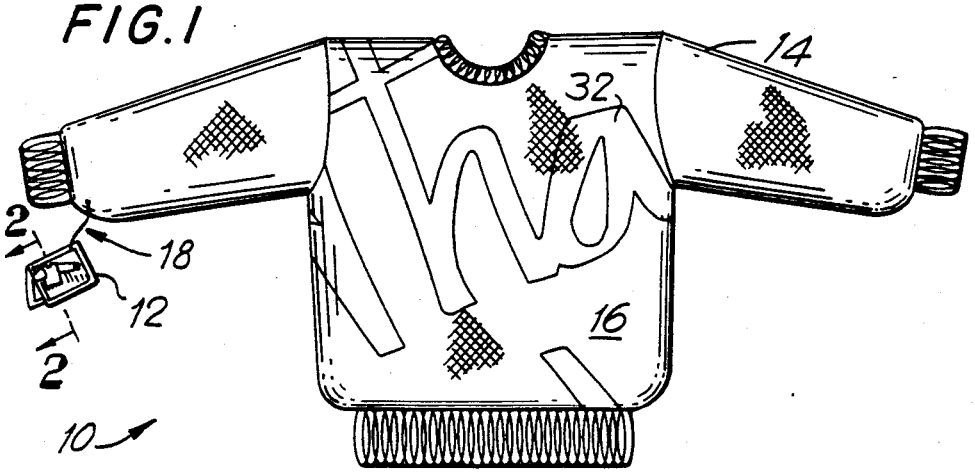
FIG. 1 is a representation of the card and gift item of the present invention coupled together for presentation.

Referring initially to FIG. 1, the present invention 10 is comprised of a greeting card 12 and an associated display element such as a sweater 14 or other gift-type item. The sweater or other gift item is of generally conventional construction, and, in the case of sweater 14, includes central chest-covering body portion or panel 16 which may be utilized to bear a design. The greeting card 12 may be affixed to sweater 14 by means of a connector element 18 in a manner well known in the art.

Figure 2:
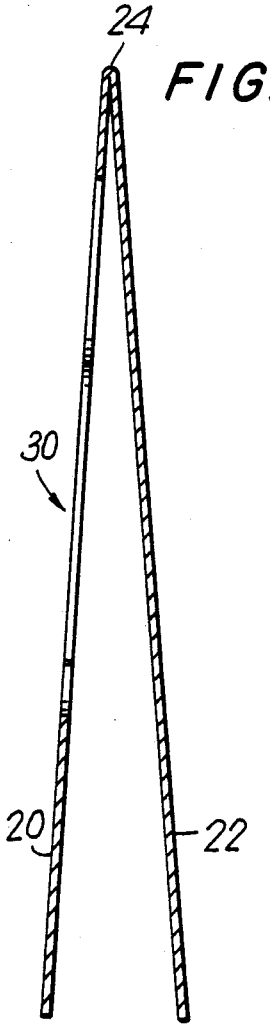
FIG. 2 is a side elevation view of the card of FIG. 1 taken in section along line 2—2.
Figure 3:
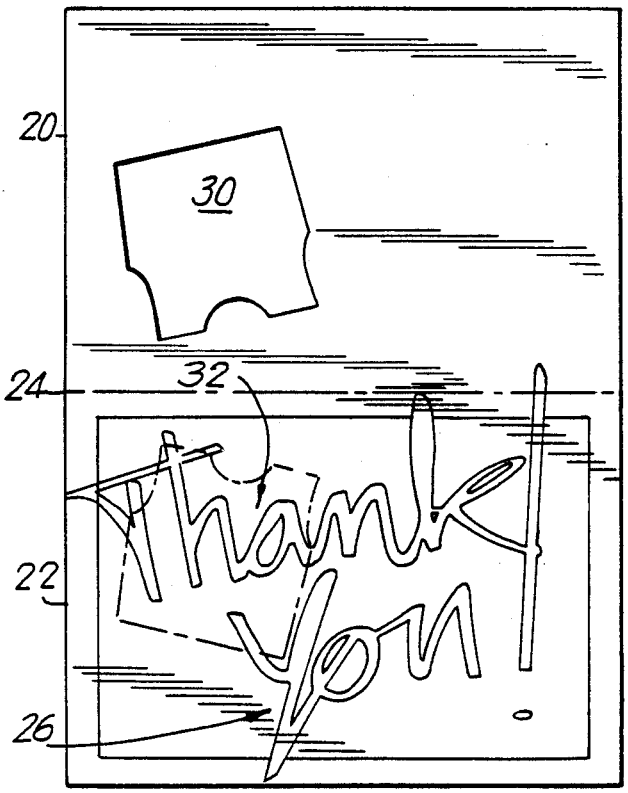
FIG. 3 is a front elevation view depicting the interior of a card in the open configuration.
Figure 4:
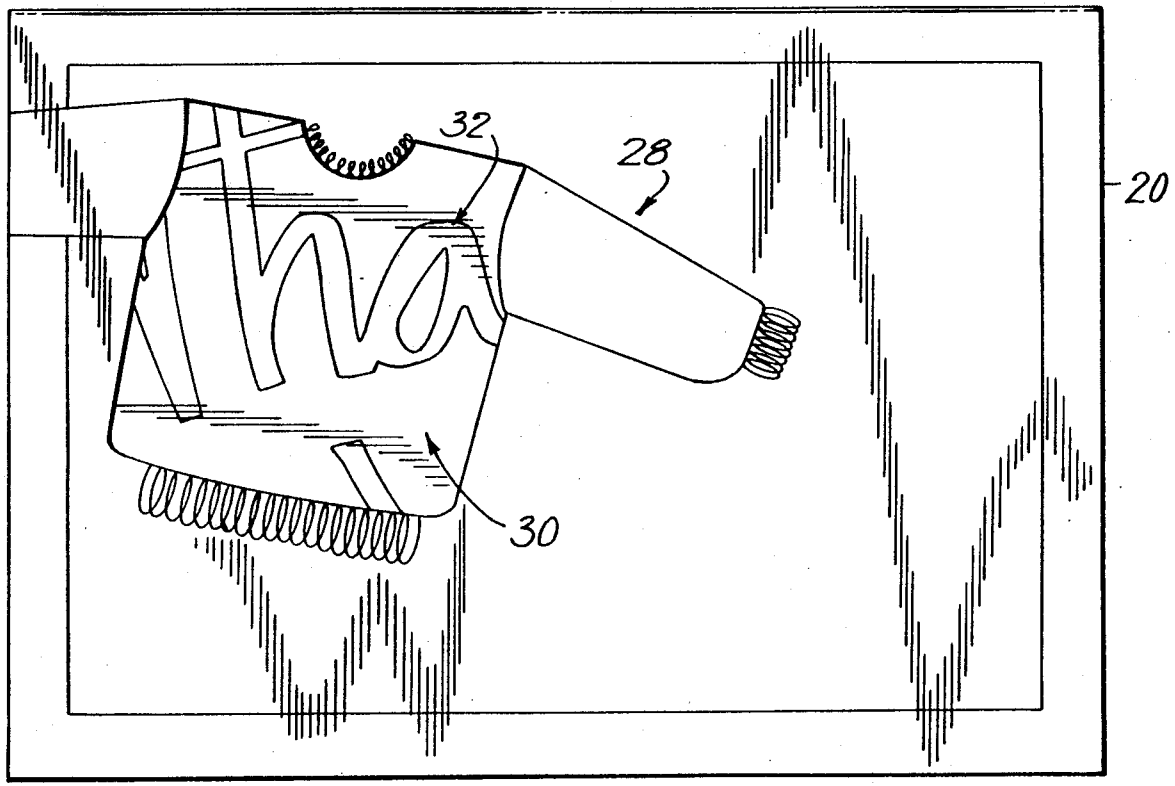
FIG. 4 is a front elevation view depicting the front of the card in the closed configuration.

As seen in FIGS. 2 through 4, the greeting card 12 has first and second panels 20, 22 pivotly joined along a common edge in a conventional manner by fold line 24. The inner panel 22 bears words of greeting or sentiment 26 appropriate for the occasion intended for the card.

First card panel 20 bears a representation 28 of the gift item 14 with which the card is associated, the representation 28 so located on the card panel as to overlie the sentiment 26 appearing on the inner surface of the card when the card is closed. A portion of the first card panel 20, lying within the outline of the gift item representation 26, is excised, creating a window 30 in the panel through which a portion 32 of the sentiment indicia 26 written on second card panel 22 can be seen. The positioning of the sentiment wording 26 on second card panel 22, as well as the representation of the gift item 28 on first card panel 20, are chosen such that the portion 32 of the sentiment appearing through the window is of an abstract character, by itself not able to be recognized as conveying the sentiment's message.

The gift item or sweater 14 to which the card 12 is affixed is provided with a duplication of the portion 32 of the sentiment appearing through the card window 30 on its surface in precisely the same orientation as the indicia portion appears on the item's representation on the card. Thus, the sweater 14 is accurately represented on the card, both sweater and representation bearing what appears to the casual observer to be an abstract pattern 32. The recipient of the gift, however, upon opening the card, recognizes that the apparently abstract design on his or her gift is a representation and portion of the sentiment 26 which appears on the card interior. The gift recipient and the giver are thus partners in a "secret" exchange, the user of the gift item being in possession of the sentiment while displaying to the public an apparently unrelated and abstract design.

It is to be appreciated that the full scope of the present invention is not intended to be limited by the previous detailed description of a preferred embodiment. For example, the gift item with which the card is associated need not be limited to a sweater nor, in fact, to an item of wearing apparel. A wide variety of items can be utilized, the item being depicted on the first card panel having a window portion therein to display a portion of the enclosed sentiment within the borders of the item displayed.

In addition, the number of window elements need not be limited to one. The representation of the gift item on the card may be in two portions, for example depicting the front and back of a sweater, each of which depictions having a window element therein through which a different portion of the enclosed sentiment may be seen. The corresponding front and back portions of the actual sweater would bear the corresponding designs. Other modifications and adaptations may similarly be accomplished and are intended to be embraced by the scope of the present invention as set forth in the annexed claims.

I claim:

1. An occasional greeting device, comprising the combination of a display element having a display panel portion thereon and a greeting card operatively connected to said first element, said card having a first, exposed panel bearing a representation of said first element, the portion of said representation depicting said display panel portion being exised to form an opening in said first panel, and a second interior panel hinged to said first panel, said second panel bearing a message sought to be delivered by said card, said message being located on said second panel whereby a portion thereof appears through said opening in said front panel when said panel is closed; the display panel portion of said display element bearing a copy of said message portion appearing through said opening.

2. The device of claim 1, wherein said display element is in the form of an item of wearing apparel.

3. The device of claim 2, wherein said first item is a sweater and said display panel section is located on the front thereof.

4. The device of claim 1, wherein the portion of the message appearing through said opening forms an abstract pattern.

* * * * *